US009328451B2

(12) United States Patent
Kappler et al.

(10) Patent No.: US 9,328,451 B2
(45) Date of Patent: May 3, 2016

(54) BULK DISPENSER FLUID LEVEL SENSING AND OUT OF BALANCE DETECTION FOR A WASHING MACHINE APPLIANCE

(71) Applicant: General Electric Company, Schenectady, NY (US)

(72) Inventors: Jerrod Aaron Kappler, Louisville, KY (US); Richard Dean Suel, II, Louisville, KY (US); Mark A. Didat, Floyds Knobs, IN (US); Alexander Boris Leibman, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/644,279

(22) Filed: Mar. 11, 2015

(65) Prior Publication Data

US 2015/0176186 A1 Jun. 25, 2015

Related U.S. Application Data

(62) Division of application No. 13/215,460, filed on Aug. 23, 2011, now abandoned.

(51) Int. Cl.

| | |
|---|---|
| ***D06F 33/02*** | (2006.01) |
| ***D06F 37/20*** | (2006.01) |
| ***D06F 39/02*** | (2006.01) |

(52) U.S. Cl.

CPC ..... *D06F 39/02* (2013.01); *D06F 33/02* (2013.01); *D06F 37/203* (2013.01); *D06F 39/022* (2013.01); *D06F 2202/08* (2013.01); *D06F 2202/085* (2013.01); *D06F 2204/10* (2013.01); *D06F 2222/00* (2013.01)

(58) Field of Classification Search

CPC ..... D06F 33/02; D06F 37/203; D06F 39/02; D06F 39/022; D06F 2202/08; D06F 2202/085; D06F 2204/10; D06F 2222/00

USPC ..... 68/12.01, 12.02, 12.04, 12.05, 12.06, 68/12.18, 12.27, 17 R

See application file for complete search history.

(56) References Cited

U.S. PATENT DOCUMENTS

| | | | | |
|---|---|---|---|---|
| 6,460,381 | B1 * | 10/2002 | Yoshida et al. | 68/12.04 |
| 2006/0117811 | A1 * | 6/2006 | Kinnetz | 68/17 R |
| 2010/0000023 | A1 * | 1/2010 | McAllister et al. | 8/137 |

* cited by examiner

*Primary Examiner* — Michael Barr
*Assistant Examiner* — Levon J Shahinian
(74) *Attorney, Agent, or Firm* — Dority & Manning, P.A.

(57) ABSTRACT

A method and apparatus for sensing the level of fluid present in a dispenser, such as a detergent or fabric softener dispenser, of a washing machine appliance and to detecting an out of balance condition for such appliance is provided. A pressure sensor is used to determine the level of fluid present and to provide indications of the same at various levels of use of the fluid. One or more pressure sensors can also be used to detect an out of balance condition when the appliance is a washing machine.

11 Claims, 4 Drawing Sheets

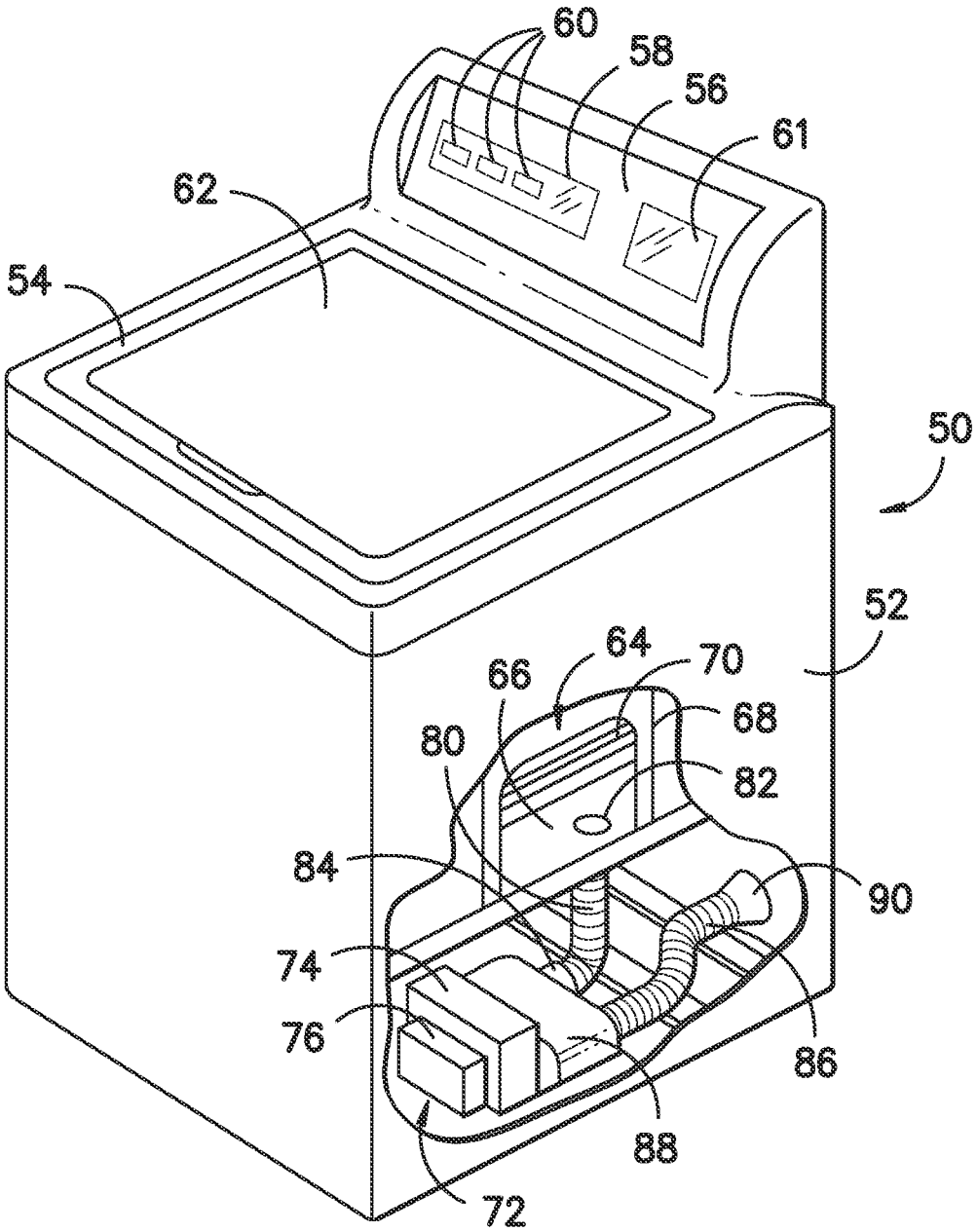
FIG. —1—

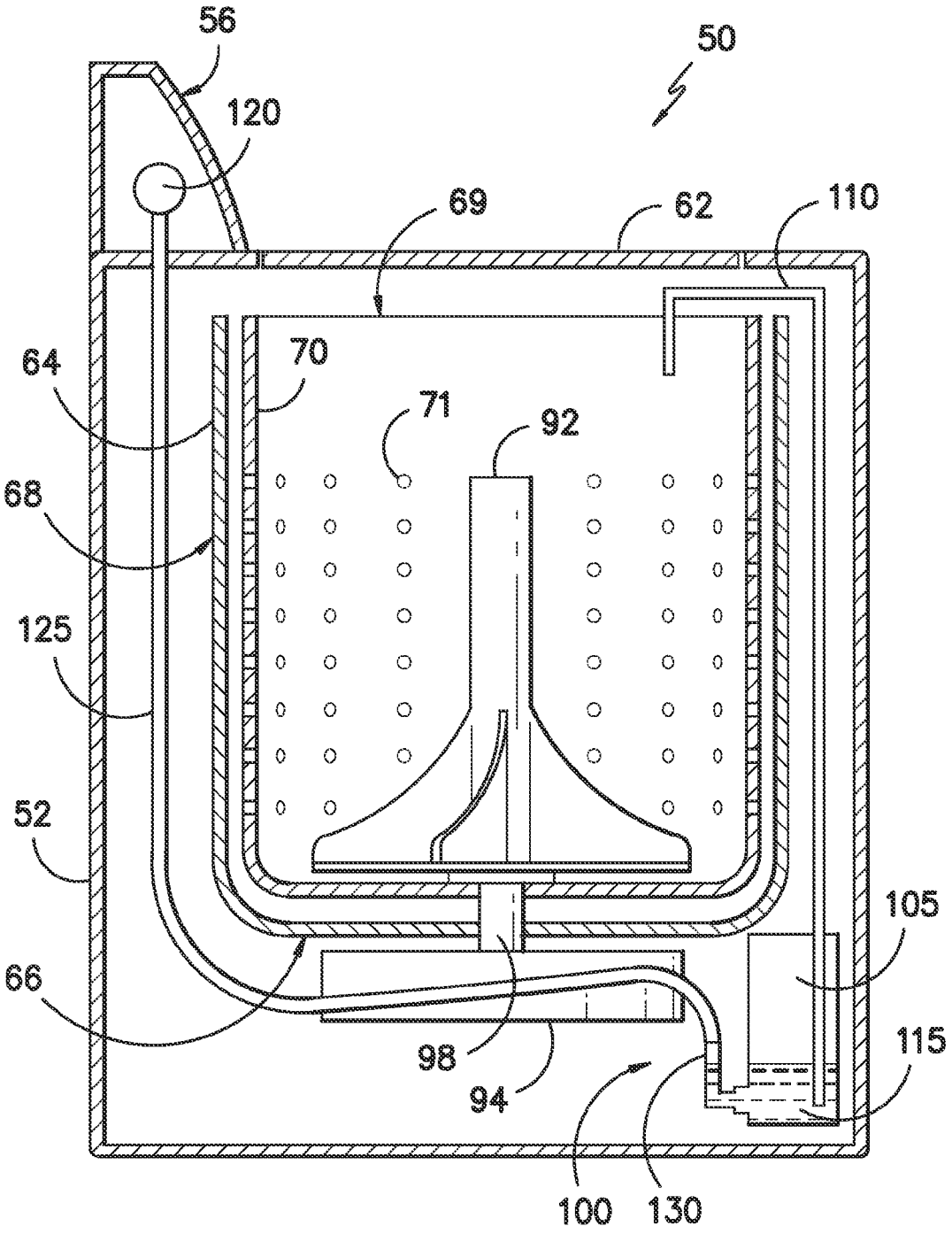
FIG. —2—

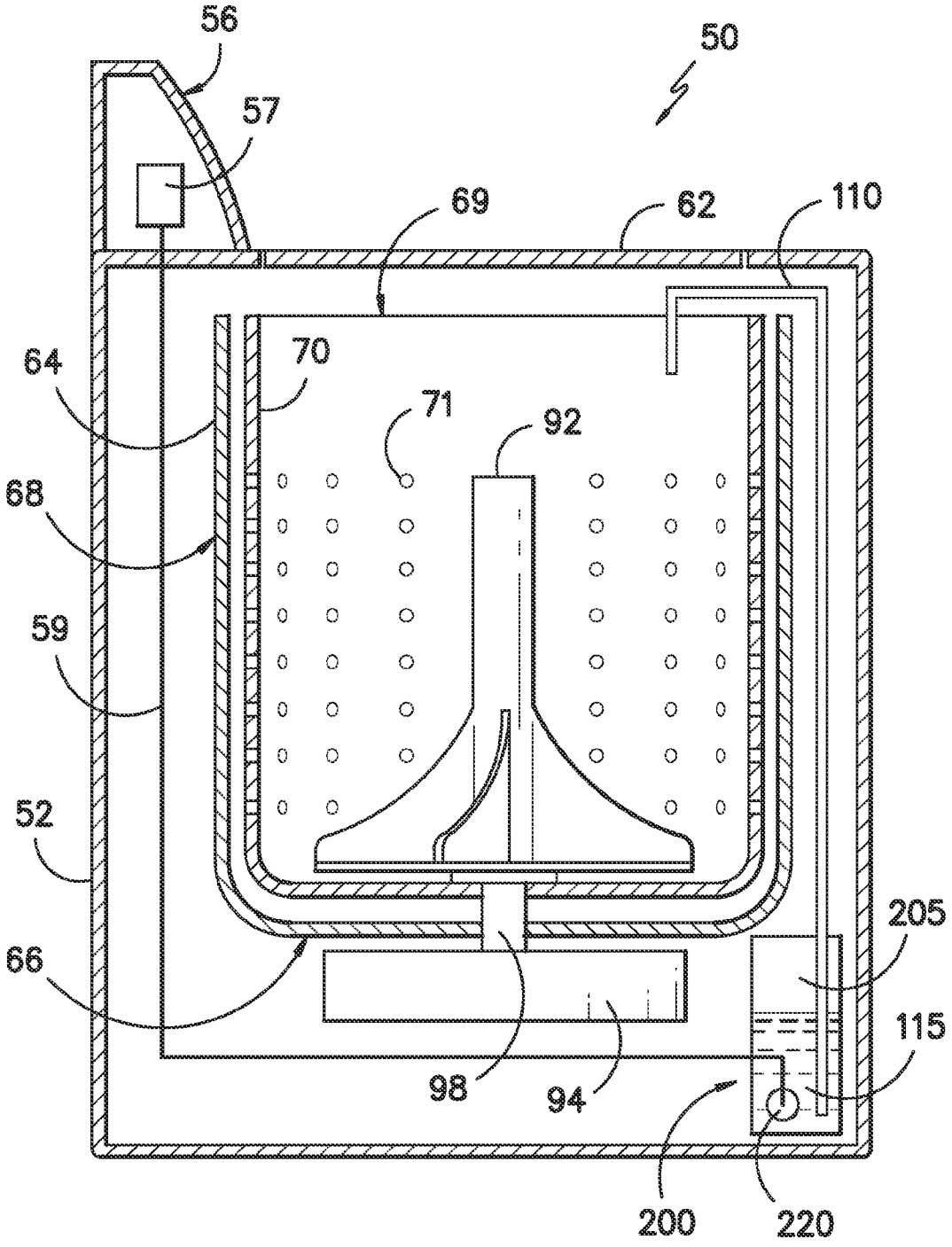
FIG. —3—

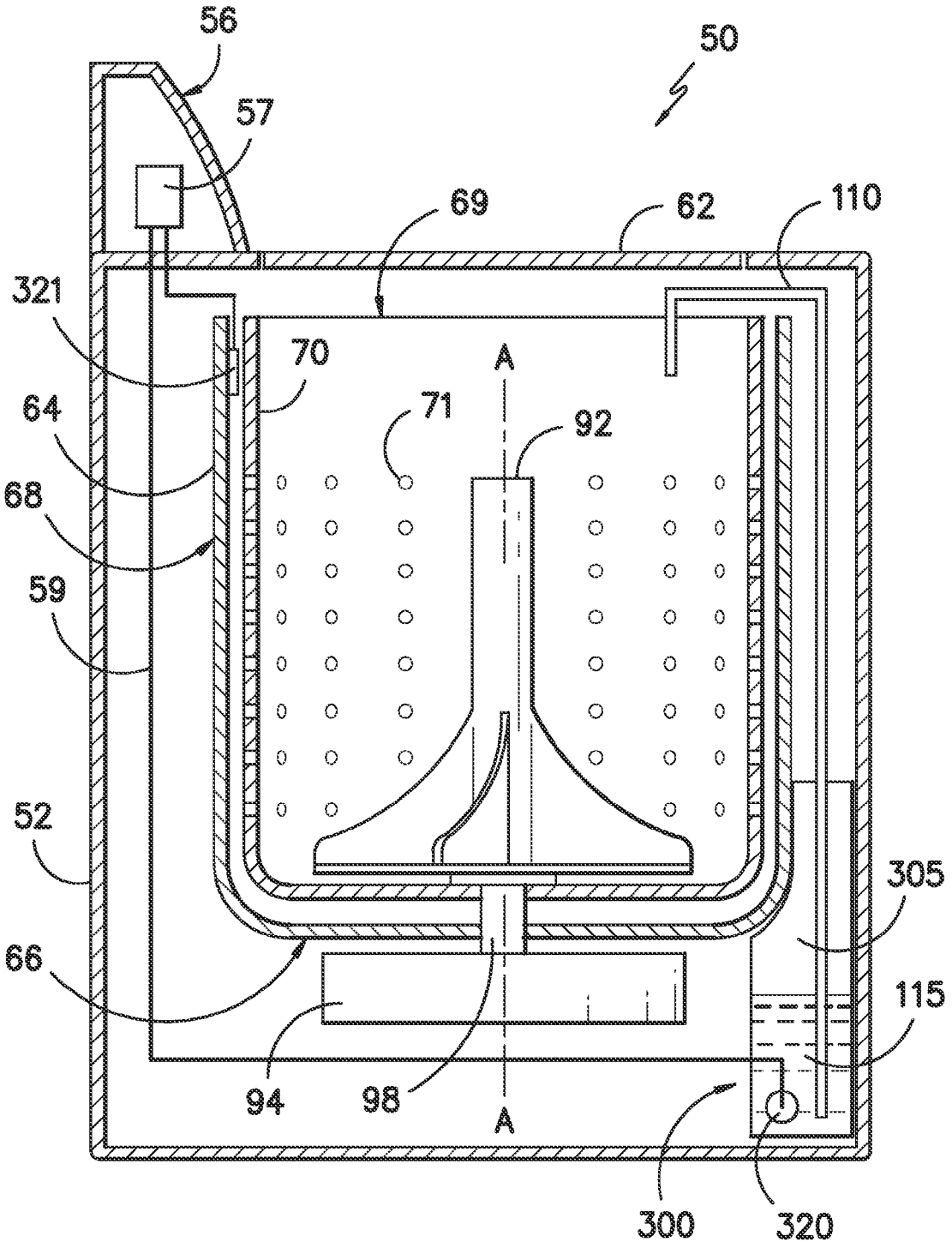
FIG. —4—

BULK DISPENSER FLUID LEVEL SENSING AND OUT OF BALANCE DETECTION FOR A WASHING MACHINE APPLIANCE

PRIORITY STATEMENT

The present application is a Divisional Application of U.S. patent application Ser. No. 13/215,460, filed Aug. 23, 2011.

FIELD OF THE INVENTION

The present invention relates to sensing the level of fluid present in a dispenser, such as a detergent or fabric softener dispenser, of a washing machine appliance and to detecting an out of balance condition for such appliance.

BACKGROUND OF THE INVENTION

The washing machine is an appliance that is commonly found in residential and commercial settings and which typically uses water to properly clean articles such as e.g., clothes, linens, towels, and other machine washable items. A detergent, generally one that contains surfactants and possibly brighteners as well, is added to the water for cleaning. A fabric softener may be used during a rinse cycle for purposes of softening the washed articles, controlling static cling, and adding a scent to the articles.

Washing machines can be equipped with fluid dispensers that automatically add detergent and/or fabric softener to a load of laundry articles at appropriate time(s) during the operation of the appliance. This option can be popular with users who do not want to manually measure and add detergent and/or fabric softener. The fluid dispenser typically includes a container that stores a limited quantity of detergent or fabric dispenser. Tubing connects the container with the wash tub and a pump or other mechanism is provided for causing fluid to exit the container and enter the wash tub.

Eventually, through operation of the washing machine, the contents of the fluid dispenser will be depleted and must be refilled. The user may be able to monitor the level of fluid in a machine by a visual inspection depending upon the particular construction of the washing machine. Alternatively, some machines have been equipped with a level sensor that uses e.g., the conductivity of the detergent or fabric softener to determine when the fluid level is below a certain level.

The use of such level sensors has certain limitations. These sensors can only determine whether fluid is present at the location where the level sensor is placed. For that reason, the level sensor is typically placed at or near the bottom of the fluid container. As a result, the level sensor cannot determine e.g., whether the container is completely full or simply at a level just at or above the sensor. As such, the user is provided with very limited advance notification of when the container will be empty. While multiple level sensors could be employed at various heights within the container, such would increase the complexity and cost of the washing machine and require a level sensor at each height in the container for which a notification is desired.

Another problem that can sometimes occur in the operation of a washing machine is an imbalance in the article load within the wash basket. More particularly, during the operation of a washing machine, particularly during spin cycles, the machine can sometimes experience an extreme vibration. Typically, this event is due to different shapes and densities of the clothing or objects that are being washed which, after the washing cycle and draining of the washing basket, can stick together and cause differences in the center of mass inside the wash basket. The vibration problem can also be caused by the introduction of relatively heavier objects into the washing basket such as e.g., shoes. By way of example, after the washing cycle and draining of the washing liquid from the basket, the shoes may be located on the same side of the washing basket or in a manner that causes the center of mass of the combined washing basket and articles (such as the shoes, clothes, and other items being washed) to be off center. As the wash basket is rotated, particularly at high speeds, the off centering and centrifugal forces create an imbalance causing the wash basket to wobble as it spins—even colliding with the wash tub in an extreme case. In turn, this imbalance can generate undesired strain in the washing machine components, an undesirable level of noise, and/or "walking" of the appliance. In an extreme or prolonged situation, the imbalance created by the excessive vibration can also wear-out and damage the washing machine components.

Accordingly, a washing machine that can provide for a more accurate detection and reporting of amount of fluid left in a dispenser would be useful. More particularly, a washing machine that can report the amount of detergent and/or fabric softener in one or more fluid dispensers at substantially all levels of such fluid would be beneficial. Such a machine that can report an out of balance condition during the operation of the washing machine would also be useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a washing machine that includes a cabinet; a wash tub received in the cabinet and configured for containing fluids used in a washing process; and a wash basket received in the wash tub and configured for the receipt of articles during the washing process. A fluid dispenser is provided for delivering a fluid into the wash tub. The fluid dispenser includes a container for the storage of the fluid. A pressure sensor is provided that is in communication with the fluid contained in the dispenser. The pressure sensor is configured to provide a signal indicative of the level of fluid present in the container of the dispenser.

In another exemplary aspect, the present invention provides a method for monitoring conditions of a washing machine having at least one fluid dispenser. The method includes the steps of providing a pressure sensor configured for detecting the pressure associated with the level of a fluid contained in the fluid dispenser; transmitting one or more signals indicative of the level of fluid in the fluid dispenser; and, providing a report to a user of the washing machine of the level of fluid remaining in the fluid dispenser.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 provides a perspective view of an exemplary embodiment of a washing machine of the present invention. A portion of the cabinet is cut away for purposes of revealing certain components as described below.

FIG. 2 is a side view of an exemplary embodiment of a washing machine of the present invention.

FIG. 3 is a side view of another exemplary embodiment of a washing machine of the present invention.

FIG. 4 is a side view of another exemplary embodiment of a washing machine of the present invention.

DETAILED DESCRIPTION OF THE INVENTION

The present invention relates to sensing the level of fluid present in a dispenser, such as a detergent or fabric softener dispenser, of a washing machine appliance and to detecting an out of balance condition for such appliance. More particularly, a pressure sensor is used to determine the level of fluid present and to provide indications of the same at various levels of use of the fluid. One or more pressure sensors can also be used to detect an out of balance condition when the appliance is a washing machine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view partially broken away of an exemplary vertical axis washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable about a hinge (not shown) between an open position (not shown) facilitating access to wash tub 64 located within cabinet 52, and a closed position (shown in FIG. 1) forming an enclosure over wash tub 64.

Wash tub 64 includes a bottom wall 66 and a sidewall 68, and a basket 70 that is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to a water outlet 90 and ultimately to a building plumbing system discharge line (not shown) in fluid communication with outlet 90.

FIG. 2 is a side elevational and schematic view of washing machine 50 including wash basket 70 movably disposed and rotatably mounted in wash tub 64 in a spaced apart relationship from tub sidewall 68 and the tub bottom 66. Basket 70 includes an opening 69 for receiving wash fluid and a wash load therein. Basket 70 includes a plurality of perforations 71 therein to facilitate fluid communication between an interior of basket 70 and wash tub 64.

An agitation element 92, such as a vane agitator, impeller, auger, or oscillatory basket mechanism, or some combination thereof is disposed in basket 70 to impart an oscillatory motion to articles and liquid in basket 70. In different embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about a vertical axis A. Basket 70 and agitator 92 are driven by pancake motor 94. As motor output shaft 98 is rotated, basket 70 and agitation element 92 are operated for rotatable movement within wash tub 64.

Washing machine 50 may also include a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 during appropriate points in washing cycles as machine 50 is used.

Operation of machine 50 is controlled by a controller or processing device 57 (shown schematically in FIGS. 3 and 4), that is operatively coupled to user interface/input selectors 60 located on washing machine backsplash 56 (shown in FIG. 1) for user manipulation to select washing machine cycles and features. In response to user manipulation of the input selectors 60, the controller operates the various components of machine 50 to execute selected machine cycles and features. As used herein, processing device may refer to one or more microprocessors or semiconductors devices and is not restricted necessarily to a single element. The processing device can be programmed to operate washing machine 50 according to the exemplary aspects of the present invention as set forth below. The processing device may include, or be associated with, one or memory elements such as e.g., electrically erasable, programmable read only memory (EEPROM).

In an illustrative embodiment, laundry items are loaded into tub 64, and washing operation is initiated through operator manipulation of control input selectors 60 (shown in FIG. 1). Wash tub 64 is filled with water and mixed with detergent to form a wash fluid, and contents of the basket 70 are agitated with agitation element 92 for cleansing of laundry items in basket 70. More specifically, agitation element 92 is moved back and forth in an oscillatory back and forth motion.

For purpose of describing the invention, a vertical axis washing machine 50 is shown in the figures (i.e. agitator 92 is oriented to rotate about a vertical axis) and is shown with a certain configuration of features. It is contemplated, however, that benefits of the present invention can apply to horizontal axis washing machines, and machines with others features and shapes as well. More specifically, the washing machine of shown in the figures is provided only by way of example. Using the teachings disclosed herein, one of ordinary skill in the art will understand the present invention may be used with washing machines of various other shapes configurations in both residential and commercial applications.

Referring now specifically to FIG. 2, washing machine 50 is also equipped with a fluid dispenser 100 for providing a fluid 115 into wash tub 64. Such fluid 115 may be e.g., laundry detergent, fabric softener, or other wash additive. Alternatively, washing machine 50 could be equipped with more than one dispenser—one each e.g., for detergent and fabric softener. Fluid dispenser 100 includes a container 105 for holding the fluid 115. A tube 110 is connected to the container 105 and provides a feed of fluid 115 to wash tub 64. Tube 110 can be equipped e.g., with a pump (not shown) controlled by a processing device for adding fluid at appropriate times during a laundry cycle to wash tub 64. Also, container 105 can be provided with various options whereby a user can refill container 105 when it is empty. For example, container 105 could have an additional tube connected to e.g., an opening on cabinet 52 whereby a user may pour detergent or fabric softener into container 105.

For the exemplary embodiment of FIG. 2, container 105 is also connected with a pressure sensor 120 by way of tube 125. Container 105 provides a pressure chamber in leg 130 to which tube 125 is attached. Accordingly, a gas such as air is trapped in tube 125 between pressure sensor 120 and fluid 115 in container 105. This gas in turn provides for communication of the pressure of fluid 115 to sensor 120—including changes in such pressure. More particularly, as the fluid level in tube 125 changes, a change in the pressure of the gas in tube 125 occurs. Pressure sensor 120 detects these changes and provides a signal indicative of the level of fluid in the dispenser. For example, assuming that the pressure in tube 125 is at ambient when container 105 is empty, the filling of container 105 with fluid 115 will cause the gas pressure in tube 125 to increase. As fluid 115 is removed from container 105 during operation of machine 50, the level of fluid 115 will drop—thereby reducing the gas pressure in tube 125. These changes in pressure are detected by pressure sensor 120, which can provide a signal to e.g., the processing device that indicates the level of fluid remaining in container 105. Accordingly, unlike a conventional level sensor, the exemplary embodiment of FIG. 2 can provide indications to the user of the amount of fluid remaining in container 105 over the range of levels that occur during use.

For example, the processing device could provide a signal (e.g., a display) of the remaining fluid level in dispenser 105 to the user. In this embodiment, the processing device would provide a real time indication of the actual level in the dispenser at any given time. Alternatively, or in addition thereto, the processing device could also by equipped to provide a visible or audible alarm or other notification when the fluid in the dispenser reaches certain levels e.g., 80%, 60%, 40%, 20%, and "Low." Other configurations may be used as well. In still another embodiment of the invention, the processing device could also be equipped with an algorithm that predicts the remaining number of loads based on the level of fluid in the dispenser and/or the variables of use such as how much fluid is typically consumed for each load.

FIG. 3 provides an alternative embodiment of the present invention in which a pressure sensor 220 is positioned directly onto container 205. More specifically, pressure sensor 220 is in direct fluid communication with the fluid 115 in the container 205 of dispenser 200. By way of example, a small hole may be provided in container 205 with sensor 220 mounted directly at or into the hole to provide direct communication with the fluid. Based on the pressure measured by sensor 220, the level of fluid 115 present is readily determined. Pressure sensor 220 provides signals to a processing device 57, by connector 59, which indicates the levels of fluid 115 present in container 205 at various stages of its use. Pressure sensor 220 could be e.g., connected to a processing device that provides one or more features as described above with the embodiment of FIG. 2.

Another exemplary embodiment of the present invention is shown in FIG. 4. In a manner similar to FIG. 3, container 305 of dispenser 300 has a pressure sensor 320 that in is attached directly with container 305 and is in fluid communication with fluid 115. Using pressure measurements created by the level (i.e., height) of fluid 115 present, sensor 320 provides a signal to processing device 57 indicative of the amount of fluid 115 present in container 305. However, in a manner different from FIG. 3, container 305 of FIG. 4 has a portion that is positioned proximate to tub 70. For example, container 305 is placed with either in contact with tub 70 or close to tub 70. Additionally, container 305 is flexible or resilient such that is can change shape due to impacts with tub 70 during operation. Thus, during an out of balance condition, tub 70 will wobble or spin erratically about axis A. Depending on the severity of the imbalance, tub 70 will contact or impact container 305 so as to decrease its volume and/or cause the level of fluid 115 to fluctuate. In turn, pressure sensor 320 will detect fluctuations in pressure caused by tub 70 and will transmit one or more signals indicative of the level changes to processing device 57. Based on the fluctuating readings, processing device 57 is programmed to determine that an out of balance condition is occurring. As a result processing device 57 can take one or more actions such as providing a notification to the user (e.g., an audible alarm) and/or stopping the operation of the machine until the user can rearrange the articles in wash basket 70 to eliminate or minimize the out of balance condition. Pressure sensor 320 could also be e.g., connected to a processing device that provides one or more features as described above with the embodiment of FIG. 2. Additionally, pressure sensor 320 need not be directly attached to contained 305 and, instead, could be connected using a tube similar to the embodiment of FIG. 2 such that sensor 320 is in fluid communication with the fluid in dispenser 305.

Washing machine 50 can also be equipped with an additional pressure sensor 321 attached to e.g., tub 64. As shown in FIG. 4, pressure sensor 321 is located along a vertical wall 68 of tub 64. However, sensor 321 could also be located along the horizontal wall or bottom 66 of tub 64. Alternatively, a pressure sensor could be placed on both vertical wall 68 and bottom 66 of tub 64. During an out of balance condition, tub 64 can also experience movements that will be detected by pressure sensor 321 and communicated to processing device 57. These movements cause the internal core of the pressure sensor to move, which changes the inductance of the sensor coil. The change in inductance can be detected by the processing device. As previously described, processing device 57 can then take one or more actions such as providing a notification to the user (e.g., an audible alarm) and/or stopping the operation of the machine until the user can rearrange the articles in wash basket 70 to eliminate or minimize the out of balance condition based on the detection of inductance changes in the pressure sensor.

As stated, a variety of options for washing machine 50 can be provided to the user based on the use of a pressure sensor with the fluid dispensers as described with regard to FIGS. 2, 3, and 4. For example, based on the amount of fluid remaining as determined using pressure sensor 120, 220, or 320, the processing device can be configured to predict the number of article loads remaining. For example, in addition to (or instead of) reporting the level of the dispenser fluid, the processing device could also provide the user with notification that enough fluid remains for only "3" more article loads. Other features based on the user of a pressure sensor to determine the amount of fluid remaining may be used as well.

The above embodiments have been described using a washing machine having only one dispenser container (e.g., 105, 205, or 305). However, using the teachings disclosed herein, one of skill in the art will understand that the present invention may be used with a washing machine having multiple different fluid dispensing containers where the level of fluid in more than one container is detected during operation of the machine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine, comprising:

a cabinet;

a wash tub received in said cabinet and configured for containing fluids used in a washing process;

a wash basket received in said wash tub and configured for the receipt of articles during the washing process;

a fluid dispenser for delivering a fluid into said wash tub, said fluid dispenser comprising a container for the storage of the fluid, wherein said container is flexible and is positioned between said wash tub and said cabinet such that the impact of said wash tub on the container results in a fluid level change in the container that can be detected by a pressure sensor;

said pressure sensor configured to provide a signal indicative of a level of fluid in the container of said dispenser; and a hose connected between said pressure sensor and said container such that said pressure sensor is not attached directly to said container, said hose containing a gas that provides fluid communication between the fluid in said container and said pressure sensor whereby the pressure sensor can detect the level of fluid present in said container.

2. A washing machine as in claim 1, wherein said container of said fluid dispenser comprises a pressure chamber to which said hose is attached.

3. A washing machine as in claim 1, wherein said container of said fluid comprises a leg containing the pressure chamber.

4. A washing machine as in claim 1, wherein said container is positioned proximate to said wash tub such that an out of balance condition will cause said wash tub to impact said container.

5. A washing machine as in claim 1, further comprising a processing device, said processing device configured for receiving the signal from said pressure sensor; and, causing the level or amount of fluid present in said container of said dispenser to be reported to a user of the washing machine.

6. A washing machine as in claim 5, wherein said processing device is further configured to predict the remaining number of article loads that can be treated with the fluid remaining in said fluid dispenser.

7. A washing machine as in claim 1, wherein said fluid dispenser is a laundry detergent dispenser or a fabric softener dispenser.

8. A washing machine as in claim 1, further comprising:

an additional pressure sensor positioned on said wash tub and configured for detecting an out of balance condition and providing a signal indicative of such out of balance condition.

9. A washing machine as in claim 8, further comprising a processing device, said processing device configured for receiving signals from said pressure sensor and said additional pressure sensor;

causing the level or amount of fluid present in the container of said dispenser to be reported to a user of the washing machine;

determining whether an out of balance condition has been detected by said additional sensor; and, activating a signal to the user of an out of balance condition if such is determined in said step of determining.

10. A washing machine as in claim 1, wherein the fluid delivered by said fluid dispenser is selected from the group consisting of laundry detergent, fabric softener, wash additive, rinse additive, and combinations thereof.

11. A washing machine as in claim 1, wherein the pressure sensor is positioned behind a backsplash of the washing machine.

* * * * *